US005690250A

United States Patent [19]

Gooding, Jr. et al.

[11] Patent Number: 5,690,250

[45] Date of Patent: Nov. 25, 1997

[54] FOLDED PAPER NAPKIN FOR DISPENSING FROM A PAPER NAPKIN DISPENSER

[75] Inventors: Chester W. Gooding, Jr.; Maurice J. Mead, both of Neenah, Wis.

[73] Assignee: James River Corporation of Virginia, Richmond, Va.

[21] Appl. No.: 611,212

[22] Filed: Mar. 5, 1996

[51] Int. Cl.[6] ..... A47K 10/24

[52] U.S. Cl. ..... 221/47; 206/494

[58] Field of Search ..... 221/33, 45, 47, 221/48; 206/449, 494

[56] References Cited

U.S. PATENT DOCUMENTS

| | | | |
|---|---|---|---|
| 550,280 | 11/1895 | Lorenz | 206/449 |
| 1,177,466 | 3/1916 | Winter | 206/494 |
| 1,681,639 | 8/1928 | Hansen | 273/391 |
| 2,621,788 | 12/1952 | Hitchcock | 206/57 |
| 2,933,431 | 4/1960 | Sperouleas | 167/84 |
| 3,047,141 | 7/1962 | Burns | 206/57 |
| 3,119,516 | 1/1964 | Donovan | 221/47 |
| 4,143,762 | 3/1979 | Spiegelberg | 206/210 |
| 4,181,225 | 1/1980 | Spiegelberg | 206/494 |
| 4,859,518 | 8/1989 | Schutz | 428/126 |
| 5,118,554 | 6/1992 | Chan et al. | 428/126 |

*Primary Examiner*—Kenneth Noland
*Attorney, Agent, or Firm*—Thomas R. Lampe

[57] ABSTRACT

A folded paper napkin includes four paper sheet panels interconnected by fold lines. The folded paper napkin is for dispensing from a paper napkin dispenser having a dispenser opening. A grasping tab is presented to the user at the dispenser opening to retrieve the paper napkin therefrom whether the paper napkin is positioned frontwards or backwards in the dispenser.

3 Claims, 2 Drawing Sheets

FOLDED PAPER NAPKIN FOR DISPENSING FROM A PAPER NAPKIN DISPENSER

TECHNICAL FIELD

This invention relates to a folded sheet product. The invention has particular application to a paper napkin constructed from a sheet of paper material (which may be single or multiple ply) and adapted for dispensing from a paper napkin dispenser having a dispenser opening.

BACKGROUND ART

It is well known to serially dispense folded paper napkins from a paper napkin dispenser having a dispenser opening. Typically, but not exclusively, such dispensers are employed in restaurants and at other sites where food is made available to consumers.

One form of paper napkin dispenser commonly employed is a dispenser which has an interior and an opening in the dispenser communicating with the interior. A plurality of folded paper napkins are inserted in the interior for dispensing through the opening, the folded paper napkins being so positioned that a panel end is located at the opening to provide a pull tab for manual grasping by the consumer to pull the napkin from the dispenser. Subsequent napkins within the dispenser are serially presented at the opening in precisely the same manner as further dispensing of napkins continues.

Proper operation depends upon the folded paper napkins being properly positioned within the paper napkin dispenser when the dispenser is being refilled. However, on occasion, due to inattention or for some other reason, a person refilling the dispenser will inadvertently reverse the paper napkins so that they are presented backwards, i.e. back side to the dispenser opening. For conventional folded paper napkin constructions this means that a grasping tab will not be presented at the dispenser opening and proper napkin dispensing will not occur. Napkins can be ripped and mutilated and significant product wastage can occur.

The following United States patents are believed representative of the current state of the prior art in this field: U.S. Pat. No. 550,280, issued Nov. 26, 1895, U.S. Pat. No. 3,119,516, issued Jan. 28, 1964, U.S. Pat. No. 1,177,466, issued Mar. 28, 1916, U.S. Pat. No. 4,859,518, issued Aug. 22, 1989, U.S. Pat. No. 3,047,141, issued Jul. 31, 1962, U.S. Pat. No. 5,118,554, issued Jun. 2, 1992, U.S. Pat. No. 4,181,225, issued Jan. 1, 1980, U.S. Patent No. 4,143,762, issued Mar. 13, 1979, U.S. Pat. No. 2,933,431, issued Apr. 19, 1960, U.S. Pat. No. 2,621,788, issued Dec. 16, 1952 and U.S. Pat. No. 1,681,639, issued Aug. 21, 1928.

Some of the above-identified patents disclose folded paper sheet material products which are to be dispensed from dispensers of various types. There is no showing in these patents of the particular folded paper napkin structure disclosed and claimed herein which allows for proper dispensing of the folded paper napkin from and through a dispenser opening regardless of whether the folded paper napkin is oriented "frontwards" or "backwards" within the dispenser interior.

DISCLOSURE OF INVENTION

The present invention relates to a specific folded paper napkin construction which is adapted for dispensing from a paper napkin dispenser having a dispenser opening. The construction of the folded paper napkin is such that a grasping tab will be presented to a consumer at the dispenser opening regardless of whether the folded paper napkin is deployed "frontwards" or "backwards" within the dispenser interior.

The folded paper napkin includes a rectangular-shaped first paper sheet panel defined by a first paper sheet panel free edge and a first fold line spaced from the first paper sheet panel free edge and parallel thereto. The first paper sheet panel free edge is located a distance from the first fold line.

A rectangular-shaped second paper sheet panel is integral with the first paper sheet panel, adjoins the first paper sheet panel, and is in registry with the first paper sheet panel. The second paper sheet panel is defined by the first fold line and a second fold line parallel to the first fold line and spaced therefrom a distance substantially equal to the distance between the first fold line and the first paper sheet panel free edge whereby the first paper sheet panel free edge and the second fold line are in substantial registry.

The folded paper napkin also includes a rectangular-shaped third paper sheet panel integral with the second paper sheet panel, adjoining the second paper sheet panel, extending between the first paper sheet panel and the second paper sheet panel and in face-to-face engagement with the second paper sheet panel. The third paper sheet panel is defined by the second fold line and a third fold line parallel to the second fold line and spaced therefrom.

A rectangular-shaped fourth paper sheet panel is integral with the third paper sheet panel, adjoins the third paper sheet panel, is positioned between the first paper sheet panel and the third paper sheet panel, and is in face-to-face engagement with the first paper sheet panel and the third paper sheet panel. The fourth paper sheet panel is defined by the third fold line and a fourth paper sheet panel free edge parallel to the third fold line. The fourth paper sheet panel free edge and an adjoining portion of the fourth paper sheet panel project beyond the first paper sheet panel free edge and beyond the second fold line.

Other features, advantages, and objects of the present invention will become apparent with reference to the following description and accompanying drawings.

BEST MODE FOR CARRYING OUT THE INVENTION

Figure 1:
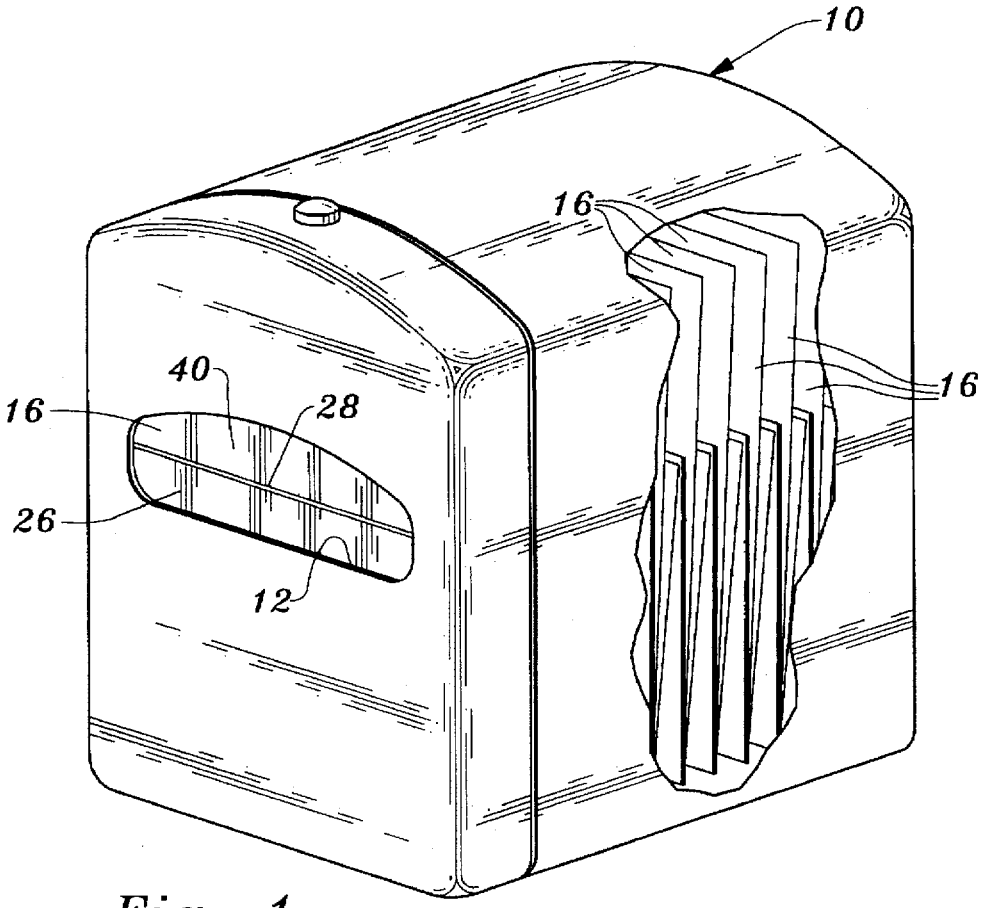
FIG. 1 is a perspective view of a paper napkin dispenser with a portion thereof cut away to disclose a plurality of folded paper napkins constructed in accordance with the teachings of the present invention disposed in the interior thereof.

Referring now to the drawings, a paper napkin dispenser of conventional construction is identified by reference numeral 10. Dispenser 10 has an interior and a dispenser opening 12 communicating with the interior.

Positioned within the dispenser interior are a plurality of folded paper napkins 16, the napkins being of identical construction. Each napkin is constructed from a sheet of paper material of uniform width. The sheet may be single ply as shown or multiple ply.

Each napkin 16 includes a rectangular-shaped first paper sheet panel 18 defined by a first paper sheet panel free edge 20 and a first fold line 22 spaced from the first paper sheet panel free edge and parallel thereto. The first paper sheet panel free edge is located a fixed distance from the fold line, such distance depending upon the overall size of the napkin and the dispenser with which it is associated.

A rectangular-shaped second paper sheet panel 26 is integral with the first paper sheet panel, adjoins the first paper sheet panel, and is in registry with the first paper sheet panel. Second paper sheet panel 26 is defined by the first fold line 22 and a second fold line 28 parallel to the first fold line 22 and spaced therefrom a distance substantially equal to the distance between the first fold line and the first paper sheet panel free edge whereby the first paper sheet panel free edge and the second fold line are in substantial registry.

A rectangular-shaped third paper sheet panel 30 is integral with the second paper sheet panel, adjoins the second paper sheet panel, extends between the first paper sheet panel and the second paper sheet panel, and is in face-to-face engagement with the second paper sheet panel. Third paper sheet panel 30 is defined by the second fold line 28 and a third fold line 34 which is parallel to the second fold line and spaced therefrom. The third paper sheet panel is substantially the same size and configuration as the second paper sheet panel and the third fold line 34 is immediately adjacent to and parallel to first fold line 22.

A rectangular-shaped fourth paper sheet panel 40 is integral with the third paper sheet panel 30, adjoins the third paper sheet panel, is positioned between the first paper sheet panel 18 and the third paper sheet panel, and is in face-to-face engagement with the first paper sheet panel and the third paper sheet panel.

Fourth paper sheet panel 40 is defined by the third fold line 34 and a fourth paper sheet panel free edge 42 parallel to the third fold line 34. The fourth paper sheet panel free edge and an adjoining portion of the fourth paper sheet panel project beyond the first paper sheet panel free edge and beyond the second fold line.

Figure 4:
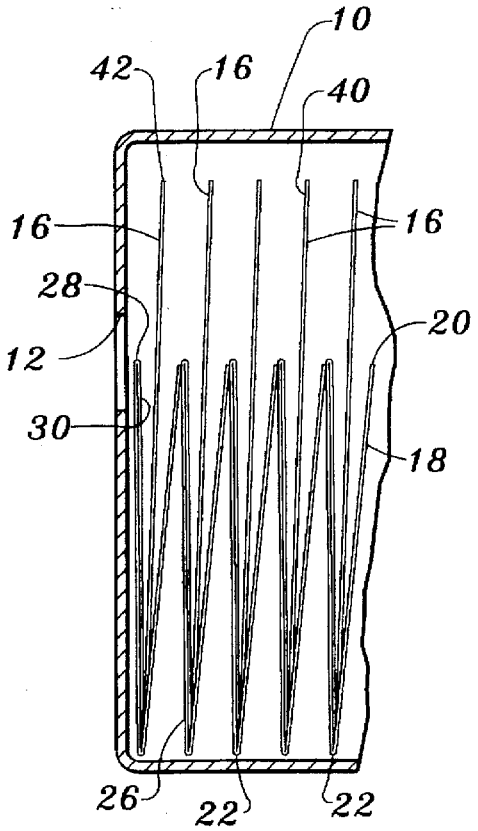
FIG. 4 is a sectional view taken through a portion of the dispenser and showing from the side a plurality of paper napkins constructed in accordance with the teachings of the present invention within the dispenser interior with the paper napkins having a first orientation with respect to the dispenser.
Figure 6:
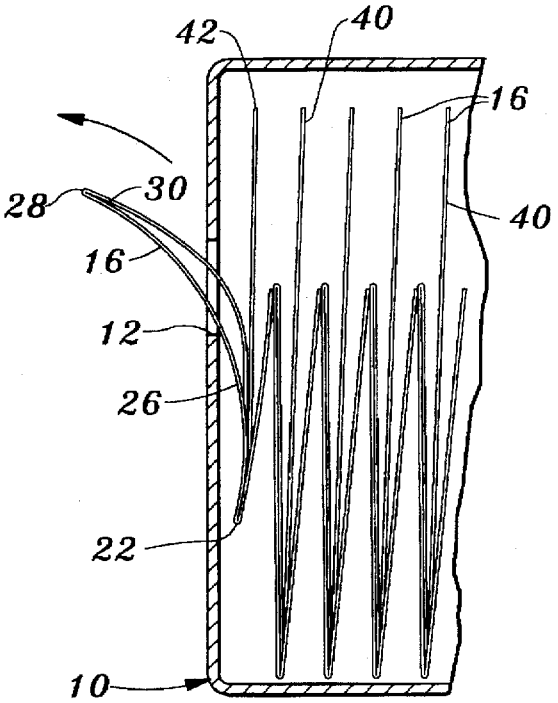
FIG. 6 is a view similar to FIG. 4 showing the napkins in the orientation shown in FIG. 4 with one of the napkins being withdrawn from the dispenser opening.

In FIGS. 1, 4 and 6, the folded paper napkins 16 are positioned within the interior of the dispenser with second paper sheet panel 26 facing forward toward the dispenser opening 12. Second fold line 28 is located at the opening so that the user can readily grasp the grasping or pull tab comprising the upper portions of second paper sheet panel 26 and third paper sheet panel 30 to pull the front napkin from the dispenser through the opening as shown in FIG. 6.

Figure 5:
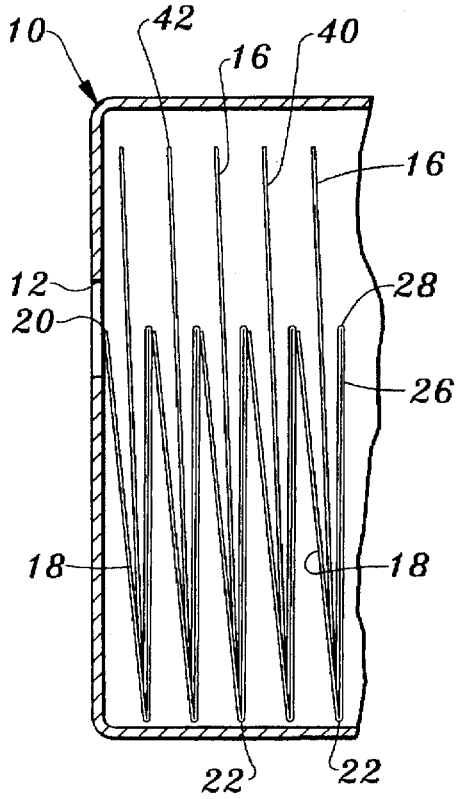
FIG. 5 is a view similar to FIG. 4 but illustrating the napkins in an alternative orientation within the dispenser interior.
Figure 7:
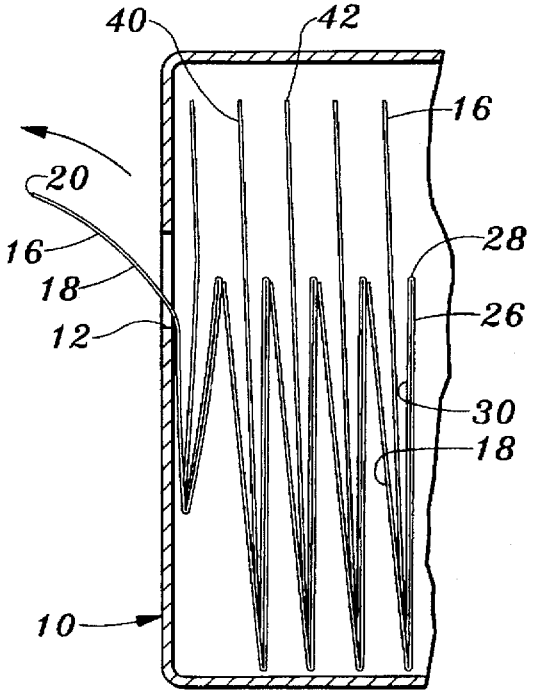
FIG. 7 is a view similar to FIG. 6 but illustrating the napkins oriented as shown in FIG. 5, one of the napkins being withdrawn from the dispenser interior through the dispenser opening.

In FIGS. 5 and 7, on the other hand, the paper napkins 16 have been positioned in the dispenser interior with first paper sheet panel 18 oriented toward the front or dispensing opening side of the dispenser. In this instance first paper sheet panel free edge 20 is located at the opening and the first paper sheet panel 18 is utilized to pull the napkin through the dispenser opening as shown in FIG. 7.

Figure 2:
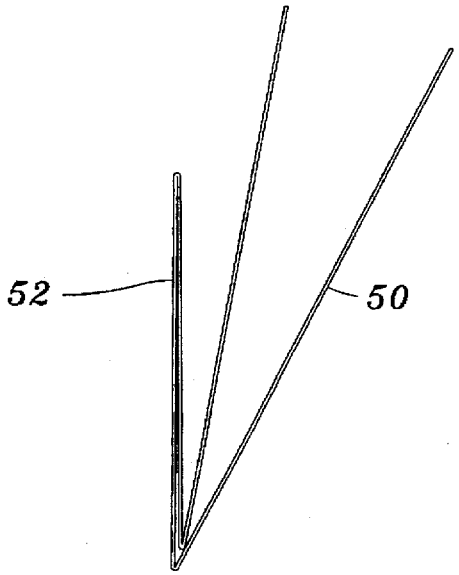
Fig. 2 (Prior Art)
FIG. 2 is a side view of a conventional prior art folded paper napkin suitable for use in the dispenser shown in FIG. 1.
Figure 3:
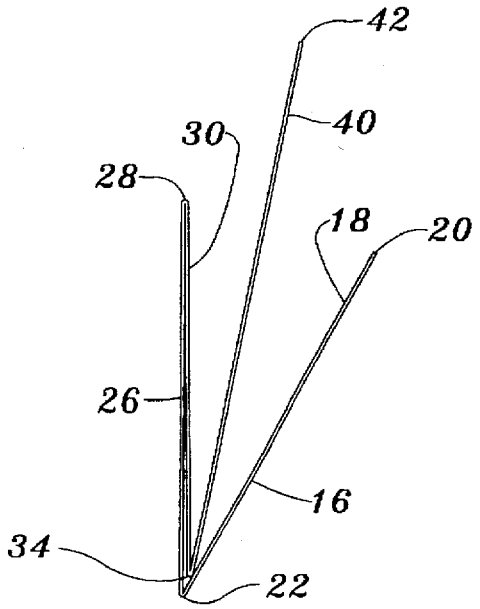
FIG. 3 is a side, elevation view of a folded paper napkin constructed in accordance with the teachings of the present invention.

It will thus be seen that the folded paper napkins 16 readily can be removed from the dispenser 10 regardless of whether the paper napkins are "frontwards" or "backwards." This eliminates the problems inherent in conventional prior art folded paper napkin constructions such as that shown in FIG. 2 wherein one panel 50 at the back of the napkin is considerably longer than forward panel 52. The napkin shown in FIG. 2 cannot properly be dispensed from its associated dispenser if reversed and the panel 50 is presented at the dispenser opening.

We claim:

1. A folded sheet product formed from a unitary sheet of sheet material of uniform width and adapted for dispensing from a dispenser having a dispenser opening in either a frontward or backward orientation, said folded sheet product comprising, in combination:

a rectangular-shaped first sheet panel defined by a first sheet panel free edge and a first fold line spaced from said first sheet panel free edge and parallel thereto, said first sheet panel free edge located a distance from said first fold line;

a rectangular-shaped second sheet panel integral with said first sheet panel, adjoining said first sheet panel, and in registry with said first sheet panel, said second sheet panel defined by said first fold line and a second fold line parallel to said first fold line and spaced therefrom a distance substantially equal to the distance between said first fold line and said first sheet panel free edge whereby said first sheet panel free edge and said second fold line are in substantial registry;

a rectangular-shaped third sheet panel integral with said second sheet panel, adjoining said second sheet panel, extending between said first sheet panel and said second sheet panel and in face-to-face engagement with said second sheet panel, said third sheet panel defined by said second fold line and a third fold line parallel to said second fold line and spaced therefrom; and a rectangular-shaped fourth sheet panel integral with said third sheet panel, adjoining said third sheet panel, positioned between said first sheet panel and said third sheet panel, and in face-to-face engagement with said first sheet panel and said third sheet panel, said fourth sheet panel defined by said third fold line and a fourth sheet panel free edge parallel to said third fold line, said fourth sheet panel free edge and an adjoining portion of said fourth sheet panel projecting beyond said first sheet panel free edge and beyond said second fold line.

2. The folded sheet product napkin according to claim 1 wherein said third sheet panel is substantially the same size and configuration as said second sheet panel and wherein said third fold line is immediately adjacent to and parallel to said first fold line.

3. The folded sheet product according to claim 1 comprising a paper napkin, said sheet material comprising paper.

* * * * *